US005427255A

United States Patent [19]

Nook

[11] Patent Number: 5,427,255

[45] Date of Patent: Jun. 27, 1995

[54] DISPLAY SYSTEM

[75] Inventor: Thomas J. Nook, Grand Haven, Mich.

[73] Assignee: Harbor Industries, Inc., Grand Haven, Mich.

[21] Appl. No.: 101,578

[22] Filed: Aug. 3, 1993

[51] Int. Cl.[6] ..... A47F 5/00

[52] U.S. Cl. ..... 211/187; 211/184

[58] Field of Search ..... 211/187, 184, 189; 108/144, 111, 60, 61; 160/135

[56] References Cited

U.S. PATENT DOCUMENTS

| | | |
|---|---|---|
| 299,602 | 6/1884 | Ward . |
| 1,747,496 | 2/1930 | Vanderveld . |
| 1,760,456 | 5/1930 | Von Palmenberg . |
| 1,770,942 | 7/1930 | Morris . |
| 1,937,935 | 12/1933 | Zimmerman . |
| 2,102,657 | 12/1937 | Von Palmenberg . |
| 2,605,525 | 8/1952 | Thomas . |
| 3,067,882 | 11/1962 | Ribbens et al. . |
| 3,186,363 | 6/1965 | Moore . |
| 3,216,377 | 11/1965 | Gunn . |
| 3,244,127 | 4/1966 | Evans . |
| 3,247,809 | 4/1966 | Thomson . |
| 3,489,290 | 1/1970 | Larson . |
| 3,497,081 | 2/1970 | Field . |
| 3,517,623 | 6/1970 | Goldstein et al. . |
| 3,534,863 | 10/1970 | Howard . |
| 3,640,389 | 2/1972 | Snyder . |
| 3,677,202 | 7/1972 | Young . |
| 3,687,091 | 8/1972 | Boylan . |
| 3,834,092 | 9/1974 | Whisson . |
| 3,868,021 | 2/1975 | Heinrich . |
| 4,018,019 | 4/1977 | Raith et al. . |
| 4,164,287 | 8/1979 | Muller et al. . |
| 4,171,052 | 10/1979 | Winn . |
| 4,183,438 | 1/1980 | Huczek . |
| 4,186,666 | 2/1980 | Honickman . |
| 4,274,687 | 6/1981 | Bayles et al. . |
| 4,320,935 | 3/1982 | Nagelkirk . |
| 4,329,003 | 5/1982 | Manchester . |
| 4,349,113 | 9/1982 | Schreiner . |
| 4,382,640 | 5/1983 | Kashden . |
| 4,433,880 | 2/1984 | Maravelas, Jr. et al. . |
| 4,508,300 | 4/1985 | Minick . |
| 4,528,914 | 7/1985 | Montet . |
| 4,540,222 | 9/1985 | Burrell . |
| 4,561,550 | 12/1985 | Franklin . |
| 4,650,261 | 3/1987 | Winter et al. . |
| 4,684,094 | 8/1987 | Everett . |
| 4,744,612 | 5/1988 | Winter et al. . |

(List continued on next page.)

FOREIGN PATENT DOCUMENTS

| | | |
|---|---|---|
| 36899 | 5/1967 | Finland . |

(List continued on next page.)

*Primary Examiner*—Ramón O. Ramirez
*Assistant Examiner*—Sarah L. Purol
*Attorney, Agent, or Firm*—Price, Heneveld, Cooper, DeWitt & Litton

[57] ABSTRACT

A display system includes a plurality of upright dividers with shelf-supporting pins located therein, and further includes shelves that engage the protruding ends of the pins to form a rigid assembly. In one version of the display system, the upright dividers are anchored in an upright and structurally square position on conventional gondola shelving by a top bracket that engages the top rear corners of the upright dividers, which top bracket also releasably engages a back of the conventional gondola shelving. Locators engage the bottoms of the upright dividers to insure that the position of the upright dividers does not become skewed, the locators engaging a base of the conventional gondola shelving. In another version of the display system, the upright dividers are anchored in an upright and structurally square position by a top bracket and a bottom bracket, the top and bottom brackets being L-shaped and attached to studs in a wall. The dividers each include a lower rear pin that engages and anchors the dividers to the bottom bracket. Another pin engages the top bracket and the upper rear of the dividers to anchor the divider to the top bracket. The shelves stabilize the dividers relative to each other, and an elongated cross piece is attached by hook-and-loop material to the dividers to further stabilize the dividers along their front edge.

50 Claims, 8 Drawing Sheets

U.S. PATENT DOCUMENTS

| | | | |
|---|---|---|---|
| 4,765,492 | 8/1988 | Howard et al. | 211/184 X |
| 4,887,783 | 12/1989 | Franklin . | |
| 4,928,833 | 5/1990 | Huizenga . | |
| 4,936,641 | 6/1990 | Bussan et al. . | |
| 4,949,853 | 8/1990 | Klein et al. | 211/184 X |
| 5,002,248 | 3/1991 | Knape et al. . | |
| 5,004,202 | 4/1991 | Stumpf et al. . | |
| 5,127,340 | 7/1992 | Mars et al. | 211/187 X |
| 5,135,194 | 8/1992 | Langhon et al. . | |
| 5,140,915 | 8/1992 | Knape . | |
| 5,201,191 | 4/1993 | Bustos | 211/187 X |

FOREIGN PATENT DOCUMENTS

| | | |
|---|---|---|
| 1519227 | 2/1968 | France . |
| 3007952 | 10/1981 | Germany . |
| 184778 | 8/1963 | Sweden . |
| 1261512 | 1/1972 | United Kingdom . |

DISPLAY SYSTEM

BACKGROUND OF THE INVENTION

The present invention relates to a display system, and more particularly concerns a display system that can be readily assembled to conventional gondola shelving or a conventional building wall by unskilled labor in different arrangements without the use of sophisticated tools, but which is structurally rigid and aesthetically pleasing. However, the invention is not contemplated to be limited to only use with conventional gondola shelving and building walls.

Modern merchandizing requires that a display system be visually attractive to consumers, and also structurally sound so that a large number and variety of goods can be safely supported on the display system. Many display systems have been designed for this purpose, however known systems are often expensive to purchase and install since they include many specialized parts and require at least some semi-skilled labor for installation. Further, known systems do not mate satisfactorily with existing fixtures such as conventional gondola shelving, and thus additional capital expenditure and waste is incurred since the existing fixtures must be thrown away. Still further, many of these systems cannot be easily assembled into different arrangements, cannot be easily rearranged, and do not permit quick assembly and installation with unskilled labor.

Thus, a display system solving the aforementioned problems is needed.

SUMMARY OF THE INVENTION

In one aspect, the present invention includes a display system adapted for installation on a conventional shelving support having a base and a back. The display system includes a plurality of elongated upright dividers having tops, bottoms and sides with apertures being located in the sides. The display system further includes a plurality of locators engaging the bottoms of the upright dividers, the locators being adapted to engage the shelving support base, and further includes a top bracket for engaging the upright divider tops, the top bracket being adapted to releasably engage the shelving support back. A plurality of shelf-supporting members are selectively located in the apertures of the upright dividers. A plurality of shelves are provided, each shelf including opposing sides adapted to releasably and frictionally engage the shelf-supporting members, whereby assembly of the shelves to the shelf-supporting members located in the dividers, which dividers are located on the shelving support by the locators and the top bracket, permits quick assembly of the display system. In one form, the shelf-supporting members are pins with ends adapted to protrude from the upright dividers, and the shelves include notches for engaging the pin ends. The joinder of the various parts interact synergistically to provide a very strong and stable system which is structurally sound, aesthetically pleasing, and yet widely adaptable to different needs.

In another aspect, the present invention includes a display system adapted for installation on a wall, such as on a wall in a conventional building which includes 2×4 wooden studs. The display system includes an elongated top bracket and an elongated bottom bracket adapted for attachment to the wall in a predetermined spaced apart condition, the top bracket and the bottom bracket each extending the width of the flexible display system and including a plurality of longitudinally spaced anchor means along their length. The flexible display system further includes divider panels having a height sufficient to engage the top bracket and the bottom bracket when the brackets are secured in the predetermined spaced apart condition, the top and the bottom of each divider having means for engaging selected of the anchor means, the brackets being constructed to support the weight of the divider panels when the divider panels are engaged with the brackets. A plurality of shelves are adapted to be secured between the dividers to form the display system, and engaging means are provided on the divider panels for securely engaging the shelves so that the flexible display system becomes rigid upon installation of the shelves between the dividers.

The preferred embodiments of the present invention include several advantages over known systems. The display systems can be readily assembled by unskilled labor without the use of sophisticated tools onto conventional gondola shelving or building walls. Yet, the display system has a modern appearance with clean lines, and can be assembled in a variety of different functional arrangements. Still further, the assembled display system is structurally sound, yet permits quick rearrangement as desired. Notably, the display system can be assembled and/or rearranged relatively quickly and without tools.

These and other features, advantages and objects of the present invention will be further understood and appreciated by those skilled in the art by reference to the following specification, claims and appended drawings.

DETAILED DESCRIPTION OF THE PREFERRED EMBODIMENT

Figure 1:
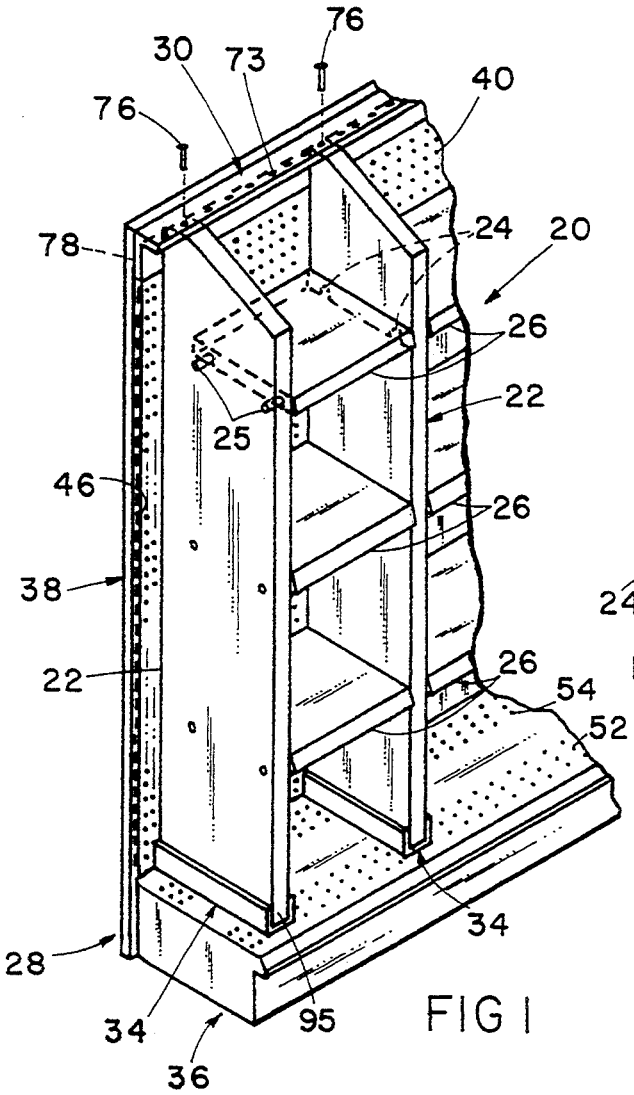
FIG. 1 is a fragmentary top front perspective view of a display system embodying the present invention, the display system being shown as installed on conventional gondola shelving.

A display system 20 (FIGS. 1 and 2) embodying the present invention includes a plurality of panel-shaped upright dividers 22 with shelf-supporting pins 24 and 25 positioned therein, and further includes shelves 26 that engage shelf-supporting pins 24 and 25 to form a rigid assembly. Display system 20 is adapted for installation on conventional gondola shelving 28, which shelving 28 includes a base 36 and an upright back 38 attached to base 36. Specifically, upright dividers 22 are secured in an upright and structurally square position on conventional gondola shelving 28 by top bracket 30, top bracket 30 being secured to the top rear corners of the upright dividers 22 and being releasably engaged to back 38 of the conventional gondola shelving 28. Locators 34 engage the bottom of upright dividers 22 to insure that the position of the upright dividers 22 do not become skewed, locators 34 engaging base 36 of the conventional gondola shelving 28 so that locators 34 properly locate the divider bottoms.

Back 38 of conventional gondola shelving 28 (FIG. 2) includes a plurality of peg boards 40 (only one of which is shown) connected by vertically oriented tubular supports or anchor rails 42 located at four foot centers. The tubular support 42 includes a flat front surface 44 with vertically oriented slots 46 therein. Base 36 (FIG. 1) of conventional gondola shelving 28 supports back 38 and extends forward of back 38, base 36 being adapted to support display system 20 and merchandizing items placed thereon in a raised position in front of back 38 above a store floor. Base 36 includes an upper surface 50 that has a series of front and rear holes 52 and 54, respectively.

Figure 4:
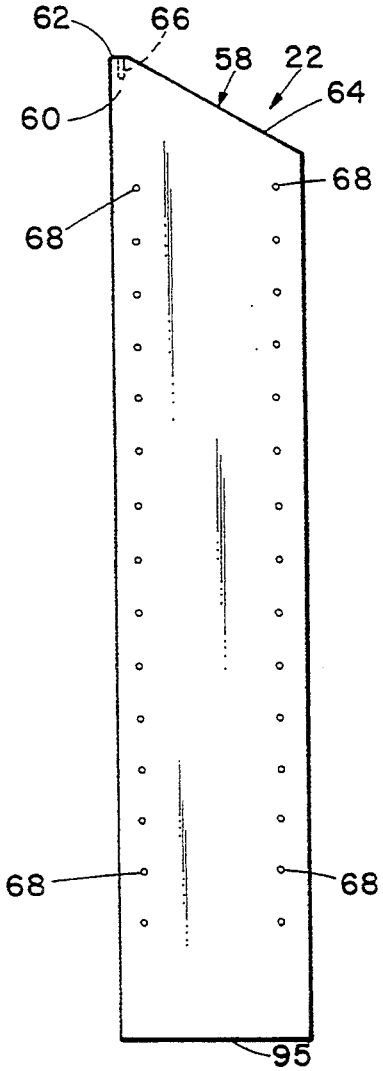
FIG. 4 is a side view of the upright divider shown in FIG. 1.

Upright dividers 22 (FIG. 4) are planar elongated structural members. The top of the upright dividers 22 can be a number of different shapes, but as illustrated top 58 of dividers 22 includes an upper rear corner 60 that forms a horizontal surface 62, and a forwardly extending portion 64 that is angled for aesthetics. A hole 66 extends vertically into the top of divider 22 through horizontal surface 62 of upper rear corner 60. Additional pin-receiving shelf-locating holes or apertures 68 extend through upright divider 22 from side to side, with pairs of holes 68 being located horizontally with respect to each other.

Figure 7:
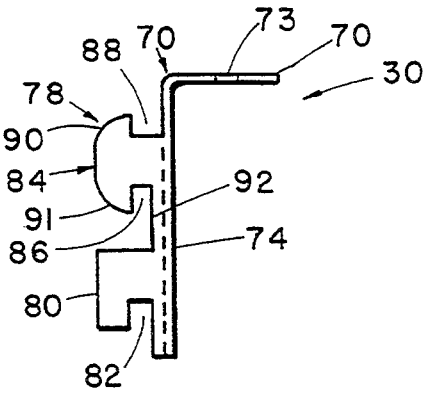
FIG. 7 is a side view of the top bracket shown in FIG. 6.
Figure 6:
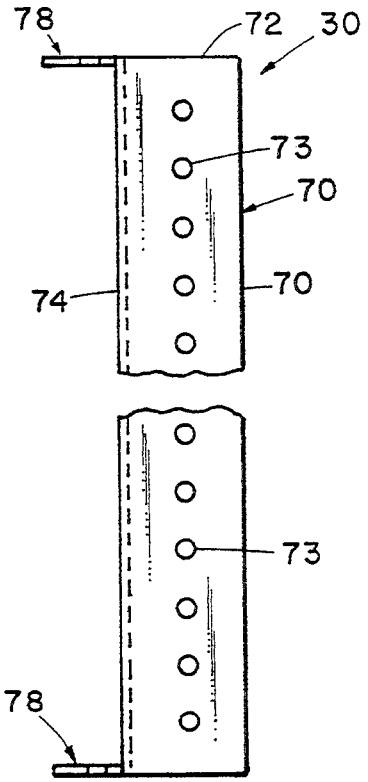
FIG. 6 is a fragmentary top view of the top bracket shown in FIG. 1.

Top bracket 30 (FIGS. 6 and 7) includes an L-shaped center portion 70 having a first leg 72 with spaced divider-locating holes 73 therein, and a second leg 74 that stabilizes first leg 72. Holes 73 are adapted to receive fasteners or divider-stabilizing pins 76 (FIG. 1), so that fasteners 76 engage holes 66 to secure upright dividers 22 to top bracket 30. Fasteners 76 can be screws if desired. A pair of teeth 78 extend perpendicularly rearwardly from each end of second leg 74 of center portion 70. The upper tooth 84 includes both a downwardly facing notch 86 adapted to engage an adjacent slot 46, and also includes an upwardly facing notch 88 adapted to lock into the slot. The outer corners 90 and 91 of upper tooth 84 are rounded to facilitate installation. Lower tooth 80 includes a downwardly facing notch 82 adapted to engage a first selected slot 46. A web 92 connects teeth 80 and 84 to each other for stability.

Figure 2:
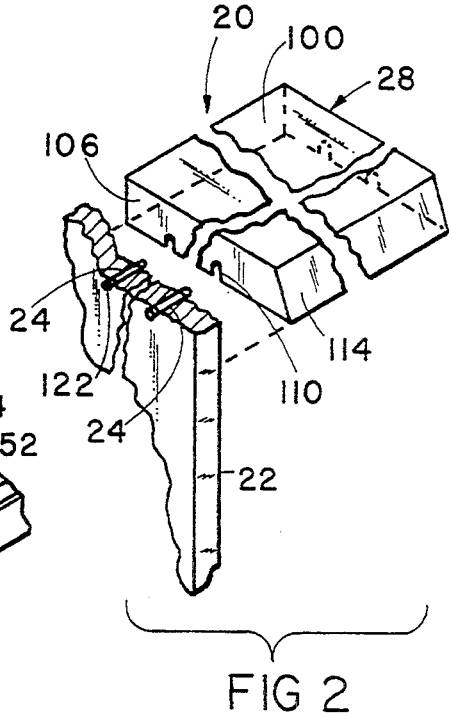
FIG. 2 is an exploded fragmentary perspective view of a shelf and an upright divider, the divider being broken away to expose the pins for attaching the shelf to the divider.

Top bracket 30 is installed by inserting upwardly facing notch 88 of upper tooth 84 into a selected slot 46 (FIG. 1). Top bracket 30 is then rotated downwardly until lower tooth 80 (FIG. 7) is positioned in an adjacent (lower) slot 46. Top bracket 30 is then dropped vertically downwardly so that both downwardly facing notches 82 and 86 (i.e. teeth 80 and 84) engage slots 46. With divider-stabilizing pins 76 (FIG. 1) inserted through hole 73 into divider hole 66, top bracket 30 cannot be rotated to a release position. Thus, once assembled, top bracket 30 cannot be removed from shelving back 38 since second leg 74 frictionally abuts divider 22 on the rear side. Thus, the upper ends of upright dividers 22 are securely interconnected and retained to top bracket 30, and also dividers 22 are securely attached to top bracket 30.

Figure 5:
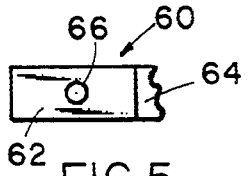
FIG. 5 is an enlarged fragmentary top view of the divider shown in FIG. 4.

Locator 34 (FIGS. 5, 8 and 9) includes an elongated upwardly facing U-shaped section 94 for receiving the lower end or bottom 95 of an upright divider 22. A pair of protrusions 96 extend downwardly from U-shaped section 94 and are adapted to engage selected holes 52 and 54 in base 36 (FIG. 1). Notably, U-shaped section 94 can be any length desired. As shown in FIG. 1, U-shaped section 94 extends to the depth of upright dividers 22, however, is it contemplated that locator 44 might only be a couple of inches long, such that a front and rear locator would then be required. Protrusions 96 on locator 34 (FIG. 8) are offset with respect to the symmetrical center line 97 of locator 34. This allows locators 34 to be used even if the locator is to be used at the end of a base 36 or where two bases 36 and 36′ are abuttingly positioned adjacent each other to form a joint 98.

It is desirable to maintain the four foot span of display system 20 from end-to-end of the display system 20 so that there are no spacing problems of the display system 20 relative to the conventional gondola shelving 28. For this purpose, a special upright divider 23 (FIG. 8) can be used as an end panel. Special upright divider 23 is half the thickness of a "standard" upright divider 22. For example, if upright divider 22 is 3/4 of an inch thick, then special upright divider 23 would be ⅜ of an inch thick. This allows display system 20 to terminate with an outer end-to-end dimension located exactly at the four foot marks on center lines 97 such as at joint 98. In turn, this allows the display system 20 to be positioned abuttingly adjacent a second display system 20 while still exactly maintaining the four foot centerline spans. Notably, two of dividers 23 (and 23′) can be positioned adjacently in U-shaped section 94 of locator 34. Further, additional thicknesses of dividers can be provided, such as an extra thin 3/16 inch thick divider. Extra thin dividers can be used where it is important to maintain a clean thin line when displaying goods on the display system. This also allows for a savings in material cost.

Figure 10:
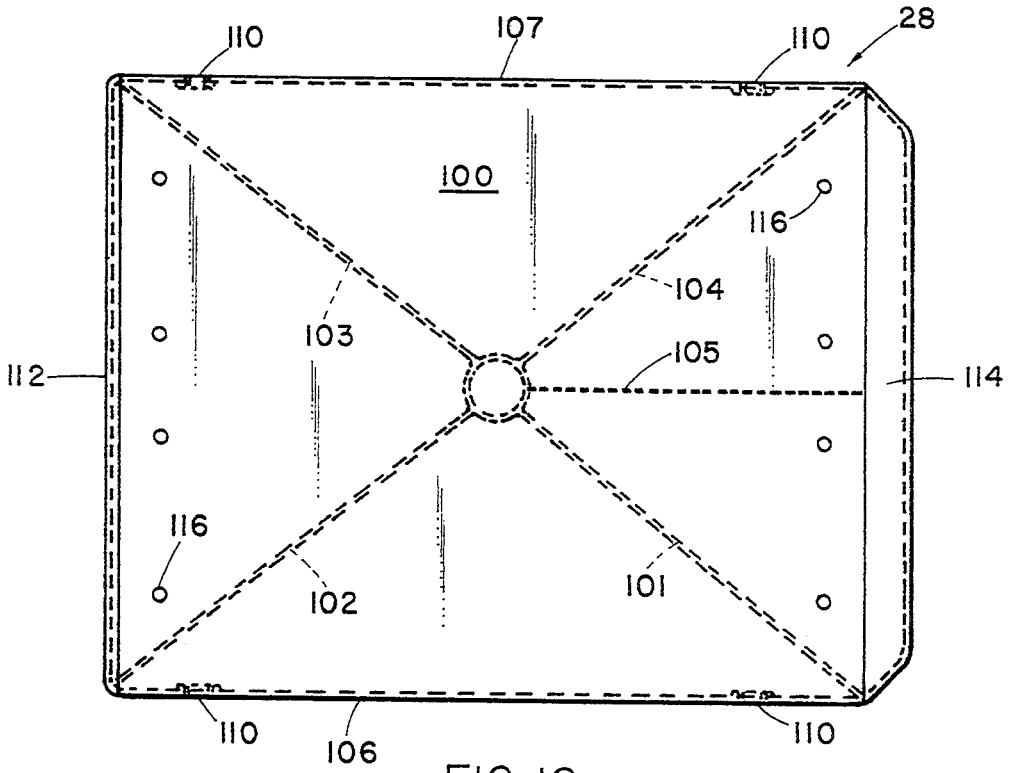
FIG. 10 is a plan view of the shelf shown in FIG. 1.
Figure 11:
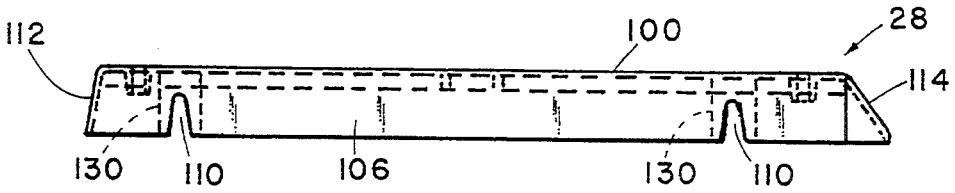
FIG. 11 is a side view of the shelf shown in FIG. 10.

Shelves 28 (FIGS. 10 and 11) are generally rectangular and include a planar midsection 100 supported by ribs 101, 102, 103, 104 and 105. Opposing side flanges 106 and 108 extend perpendicularly downwardly and include front and rear notches or recesses 110 adapted to engage pins 24 and/or 25. Rear flange 112 extends at a slight angle from perpendicular to planar midsection 100, and front flange 114 extends at an even greater angle from perpendicular to planar midsection 100. Front and rear flanges 112 and 114 are angled for aesthetics and also to facilitate molding of shelves 28. Also, front and rear flanges 112 and 114 stabilize side flanges 106 and 108. Holes 116 are located in planar midsection 100 such as for securing auxiliary dividers or "fences" (not shown) or other items to shelves 28.

Figure 12:
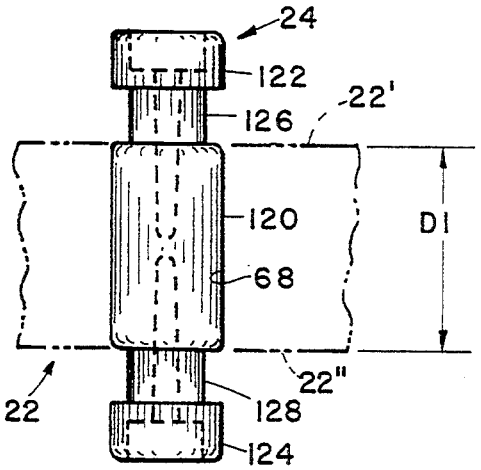
FIG. 12 is a side view of one style shelf-supporting pin.

Self-supporting pin or fastener 24 (FIGS. 2 and 12) includes a body or shaft 120 with opposing protruding ends 122 and 124. A ring-shaped depression 126 is defined between end 122 and body 120, and a similar ring-shaped depression 128 is defined between end 124 and body 120. The length D1 of body 120 is the same as the thickness of standard upright divider 22 so that depressions 126 and 128 are positioned adjacent and protruding from upright divider sides 22' and 22'' when pin body 120 is positioned in hole 68. With pins 24 located in upright divider holes 68 (FIG. 2), a shelf 28 can be positioned so that notches 110 in shelf side flanges 106 (and 108) engage ring-shaped depressions 120 (and 128). With a sharp downward blow, shelves 28 are frictionally press-fit onto pin 24 to securely retain shelf 28 thereon. Notably, side flanges 106 and 108 are about 1¼" deep so that they have sufficient distance to stably engage upright divider side 22' (and 22''). A ridge 130 on the inside of side flanges 106 and 108 around notches 110 provides increased strength to side flanges 106 and 108 in the area of notches 110.

Figure 13:
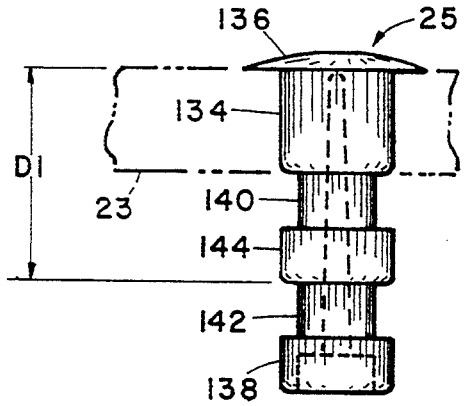
FIG. 13 is a side view of a second style shelf-supporting pin.

Shelf-supporting pin or fastener 25 (FIG. 13) is intended for use on an upright divider 23 located at an end of divider system 20, or on a divider 22 where two shelves 28 are not positioned at the same height on the opposite sides of the divider 22. Pin 25 includes a body 134 with a head 136 at one end and a protruding end 138. Two ring-shaped depressions 140 and 142 are defined between body 134 and end 138, the ring-shaped depressions being separated by a ridge 144 that is the diameter of body 134. Pin 25 can be extended through hole 68 in upright divider 22 with head 136 engaging one side of the upright divider, and the outer ring-shaped depression 142 extending out of the other side of the upright divider 22. In this configuration, body 134 and ridge 144 are located within hole 68. Shelf side flange notch 110 can be frictionally press-fit onto outer ring-shaped depression 142. Pin 25 can also be used on the half thickness upright divider 23. With pin 25 positioned in hole 68 in half thickness upright divider 23, ring-shaped depression 140 is positioned outside of hole 68 whereat inner ring-shaped depression 140 can be frictionally engaged by shelf side flange notch 110. Similarly, pins 24 and 25 can be further adapted to receive a panel of 3/16 inch thickness by the addition of additional ring-shaped depressions (not shown).

To assemble display system 20, top bracket 30 is initially positioned on conventional gondola shelving back 38 with top bracket teeth 78 engaged with support slots 46 at a selected height. Also, locators 34 are positioned as desired on conventional gondola shelving base 36 with locator protrusions 96 engaging selected base holes 52 and 54. Upright dividers 22 are then positioned in locators 34, and divider-stabilizing pins 76 are extended downwardly through top bracket holes 66 into divider top holes 66. Dividers 22 are thus temporarily semi-stably located on conventional gondola shelving 28.

Shelf-supporting pins 24 and 25 are then inserted into shelf-supporting holes 68 in dividers 22 as desired. Specifically, pins 24 are utilized at locations where there will be shelves at equal height on opposing sides of a divider 22 (see FIGS. 1 and 2). Pins 25 are utilized at locations where there will be a shelf 26 on one side but not on the other side of a divider 22, or where a divider 23 will be used. With pins 24 and 25 inserted, shelves 26 are positioned between adjacent dividers 22 (see FIGS. 1 and 2), each shelf 26 having two of pins 24 (or 25) supporting each side flange 106 (or 108) at notches 110. Shelf notches 110 can be fully frictionally seated onto pins 24 (and 25) by a sharp downward blow on the shelf 26. This positions shelf pin flanges 106 (and 108) against divider sides 22' (and 22'') and thus stabilizes display system 20.

Several modified display systems and modified components embodying the present invention are contemplated. In these modifications, comparable components and features are identified by identical numbers, but with letters "A", "B", "C" and etc. added thereto. This is intended to reduce redundant discussion.

A modified gondola shelving base 37A (FIG. 3) can be installed onto support back 28 above display system 20. Base 37A is formed comparably to base 36 insofar that it includes a comparable upper surface 50A with holes 52A and 54A therein. However, base 37A includes hooks or teeth 150A adapted to engage selected slots 46. Thus, base 37A can be positioned at any height, such as on top of or above lower display system 20. It is contemplated that the lower display system can be designed so that lower dividers 22 include a top surface adapted to abuttingly engage base 36A to support the weight of an upper display system 20A, or alternatively the upper display system 20A (i.e. alternative base 37A) can be designed so that there is limited or no contact between base 36A and lower dividers 22.

Figure 3:
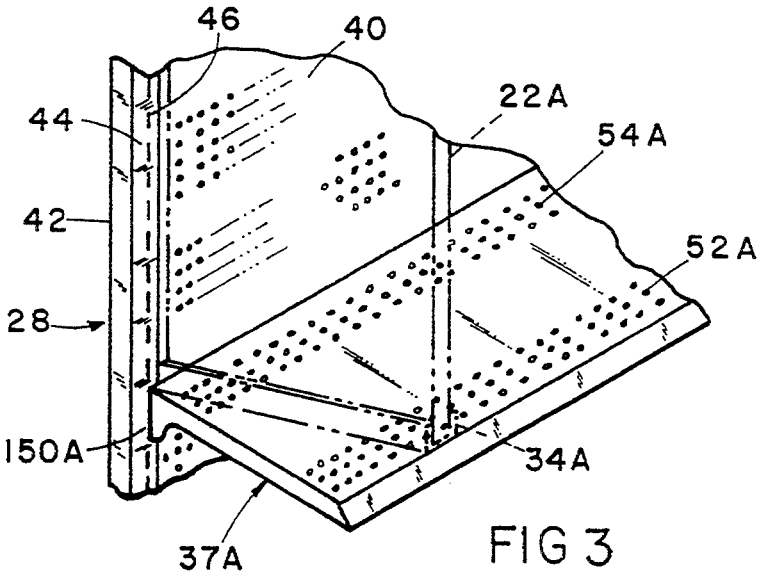
FIG. 3 is a perspective view of an alternative base attached to the conventional gondola shelving back.

Another modification is illustrated in FIG. 3. It is contemplated that one of the protrusions 96 (FIG. 9) on locator 34 can be snipped off thus allowing locator 34A to rotate 360° in plan view so that locator 34A can thus be positioned at any angle desired relative to base 37A (or base 36) and back 38. Thus a divider 22A retained thereon is located at a desired angle. In such case, special shelves (not shown) in the shape of a parallelogram with appropriately positioned shelf side flange notches 110 would be required, however the shelves would be otherwise generally as disclosed above. Also, it is contemplated that shelf-supporting holes 68 can be located in a non-horizontally paired, staggered arrangement in upright divider 22 so that shelf 26 is retained at an angle to horizontal. Alternatively, shelves 28 can be manufactured with notches arranged so that when installed on horizontally paired shelf-supporting holes 68, the shelf is retained at a desired angle.

Figure 14:
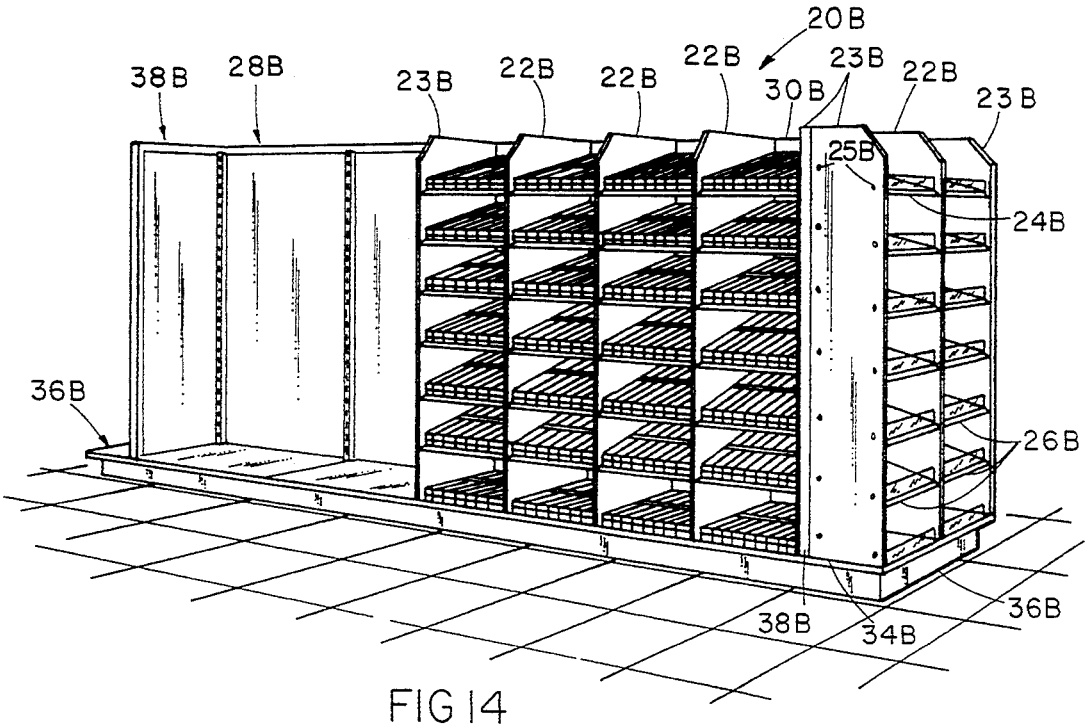
FIGS. 14–16 are perspective views of various arrangements of the display system.
Figure 15:
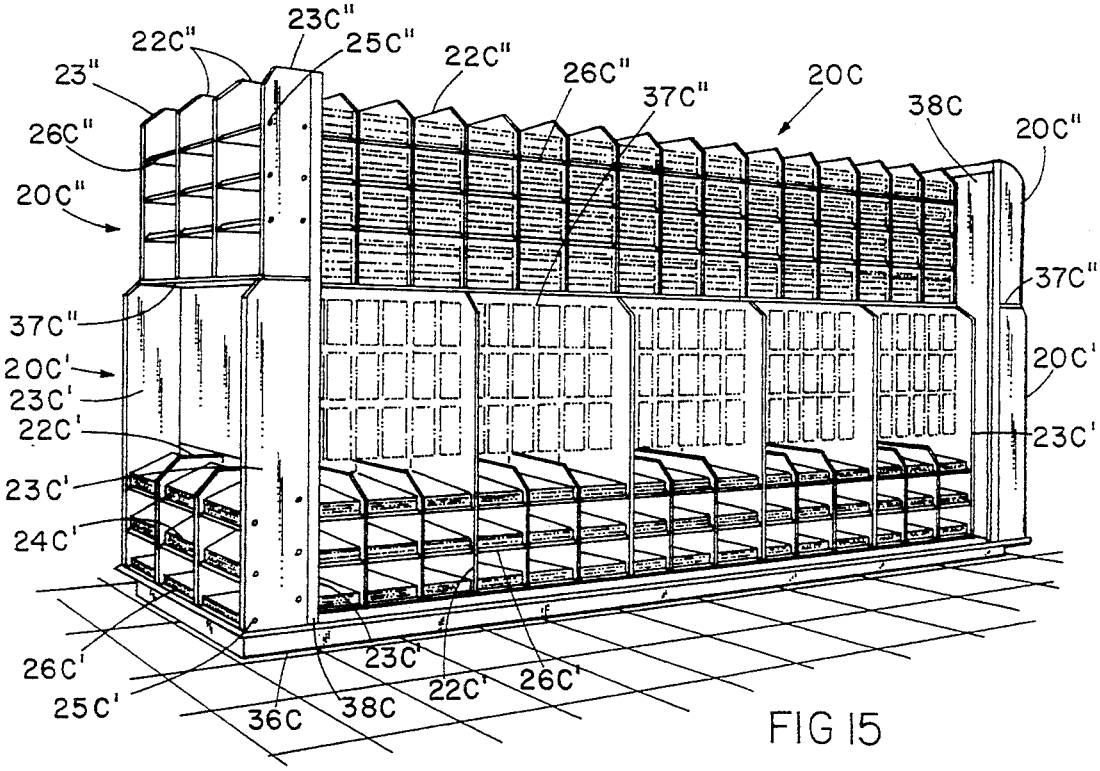
Figure 16:
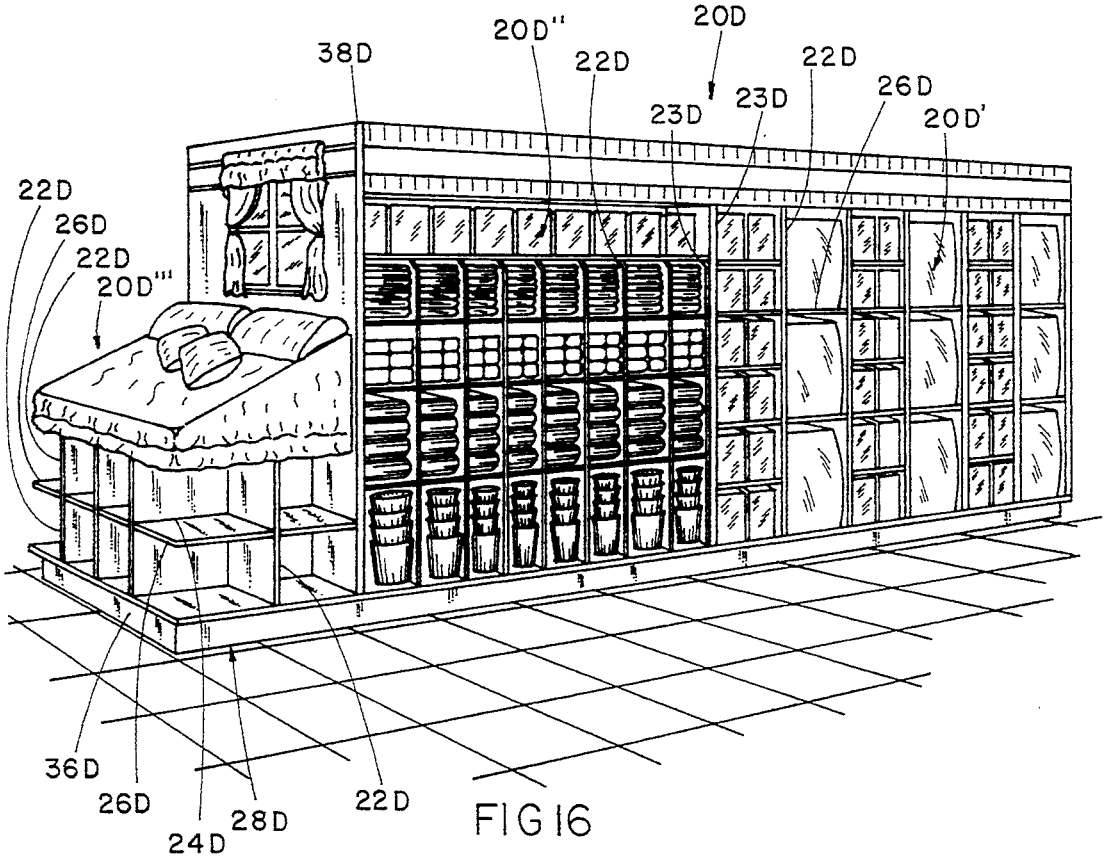

Three arrangements of the display system are shown in FIGS. 14–16, and generally referred to by numbers 20B, 20C and 20D respectively. Comparable features and components to display system 20 are designated by use of the same number plus the letters "B", "C" and "D". In display system 20B (FIG. 14), dividers 22B are located by top bracket 30B and locators 34B, and are interconnected by inclined shelves 26B. The ends of display system 20B are formed by half-thickness dividers 23B with pins 25B extended therethrough. The intermediate dividers are full thickness dividers 22B, with pins 24B (not specifically shown in FIG. 14) extended therethrough. Shelves 26B are pressed downwardly to frictionally engage pins 24B and 25B. Notably, the pairs of shelf-supporting holes (68B) in dividers 22B and 23B are located non-horizontally so that pins 25B (and 24B) are located non-horizontally and thus shelves 26B are retained in an inclined or angled position.

Display system 20C (FIG. 15) includes a lower display system 20C' and an upper display system 20C''. Lower display system 20C' includes dividers 22C' and 23C' interconnected by pins 24C' and 25C' and shelves 26C'. Upper display system 20C'' includes dividers 22C'' and 23C'' interconnected by pins 24C'' (and 25C'') and shelves 26C''. Lower display system 20C' is supported by shelving base 36C, and upper display system 20C'' is supported by shelving base 37C''.

Display system 20D (FIG. 16) illustrates yet another embodiment wherein the shelves 26D are irregularly positioned across half of the width of the display system (generally referred to by number 20D'), and are regularly positioned along the other half 20D''. Also, an end display 20D''' is positioned at an end of the conventional gondola shelving 28D.

Figure 17:
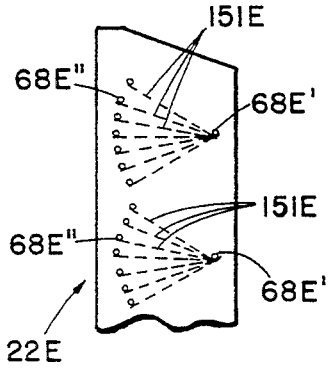
FIG. 17 is a side view of a modified divider panel embodying the present invention.

It is contemplated that the holes 25 and dividers 22 can be located in a number of different patterns and locations to facilitate placement of shelves on the dividers as desired. For example, dividers 22E (FIG. 17) are generally comparable to dividers 22, but dividers 22E include a front hole 68E' and a series of rear holes 68E''. The rear holes 68E'' are located an equal distance from front hole 68E' in an arcuate pattern. This allows pins (24 and 25) to be selectively located in holes 68E'' in panels 22E so that shelves (26) can be held at a desired angular orientation when installed. For example, shelves can be held in any of the planes 151E extending between holes 68E' and 68E''. This angularity is desirable when displaying merchandise so that the merchandise is viewed at an optimal angle by a consumer standing adjacent the display system.

Figure 18:
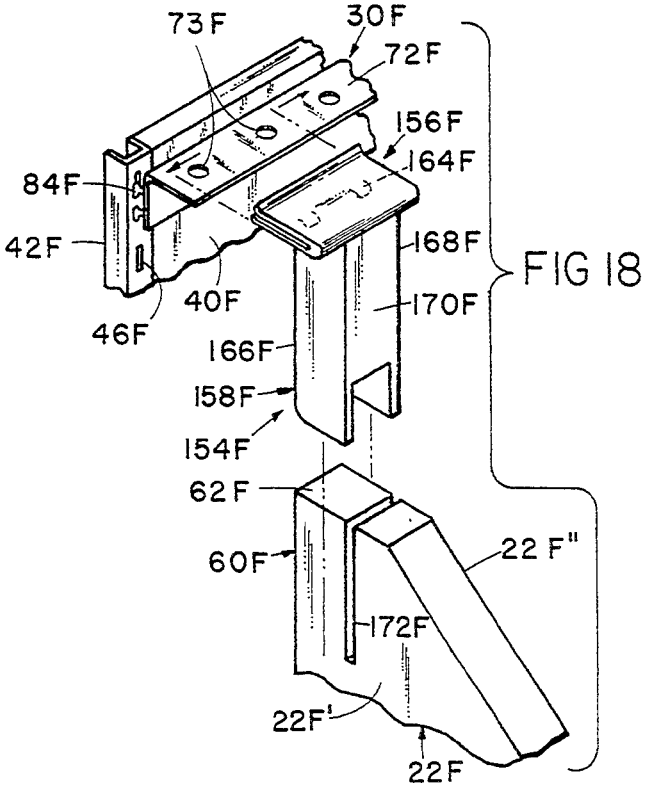
FIG. 18 is an exploded perspective view of another modification of the display system, the modification including a releasably engageable anchor bracket.
Figure 19:
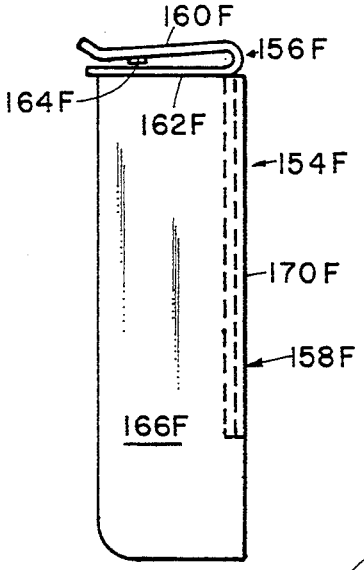
FIG. 19 is a side view of the anchor bracket illustrated in FIG. 18.
Figure 20:
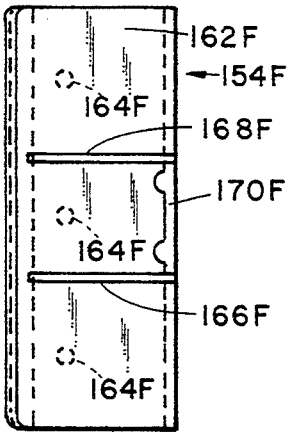
FIG. 20 is a bottom view of the anchor bracket illustrated in FIG. 18.

Another modification is illustrated in FIG. 18. In FIG. 18, pin 76 is replaced with an anchoring bracket 154F, and the upper rear corner 60F of dividers 22F are modified to receive anchoring bracket 154F. Anchoring bracket 154F (FIGS. 19 and 20) includes an upper section 156F and a lower section 158F that extends downwardly from upper section 156F. The upper section 156F has a C-shaped profile including an upper web 160F and a lower web 162F that form a throat for receiving top bracket flange 72F. A pair of protrusions 164F on upper web 160F extend into the throat, protrusions 164F being configured to securely but releasably engage holes 73F. This allows anchoring bracket 154F to be relocated horizontally along top bracket 30F to various positions as desired.

Figure 21:
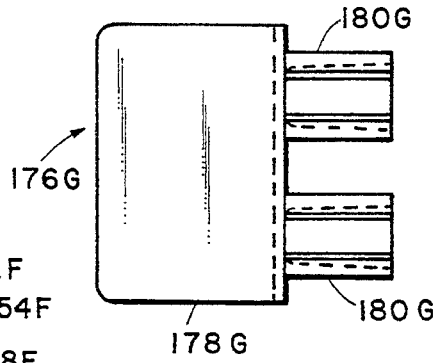
FIGS. 21–23 are orthogonal views of a modified locator bracket.

Lower section 158F (FIGS. 19 and 20) includes a pair of parallel sidewalls 166F and 168F joined by a connecting wall 170F to form a C-shaped section. Connecting wall 170F is slightly shorter than walls 166F and 168F. The upper rear corner 60F of dividers 22F (FIG. 21) are modified by a saw cut or slot 172F that extends from horizontal upper surface 62F downwardly into divider 22F a distance at least equal to the length of connecting wall 170F. Slot 172F is spaced from the rear edge of divider 22F. Connecting wall 170F fits mateably into slot 172F with anchor bracket walls 166F and 168F engaging the sides 22F' and 22F'' of divider panel 22.

Figure 8:
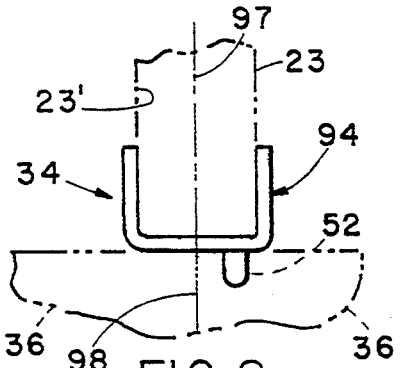
FIG. 8 is a front view of the bottom locator shown in FIG. 1.
Figure 9:
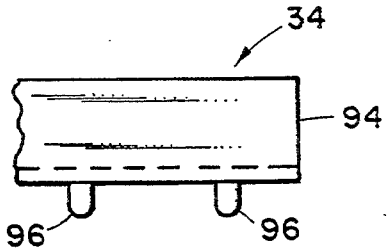
FIG. 9 is a side view of the bottom locator shown in FIG. 8.
Figure 22:
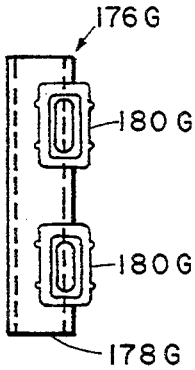
Figure 23:
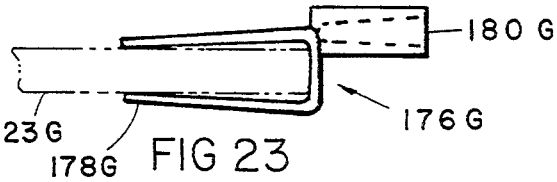

A secondary locator bracket 176G (FIGS. 21–23) can be used to stabilize half thickness divider 23 such as at a shelving end or joint 98 (see FIG. 8). Secondary locator bracket 176G includes a U-shaped section 178G adapted to engage a rear edge of a divider 23G, and further includes a pair of offset protrusions 180G. Protrusions 180G are shaped to mateably engage slots (46) in the anchor rails (42) of the conventional gondola shelving. With protrusions 180G engaged in slots (46), U-shaped section 178G prevents dividers 23G from slipping horizontally over or into a joint (98). Thus, even if the bottom of divider 23G is kicked by an operator, it cannot flex or bend out of position and drop over and into a joint (98). Thus, secondary locator bracket 176G holds dividers 23G in a vertically flat plane so that dividers 23G do not buckle and collapse.

Figure 24:
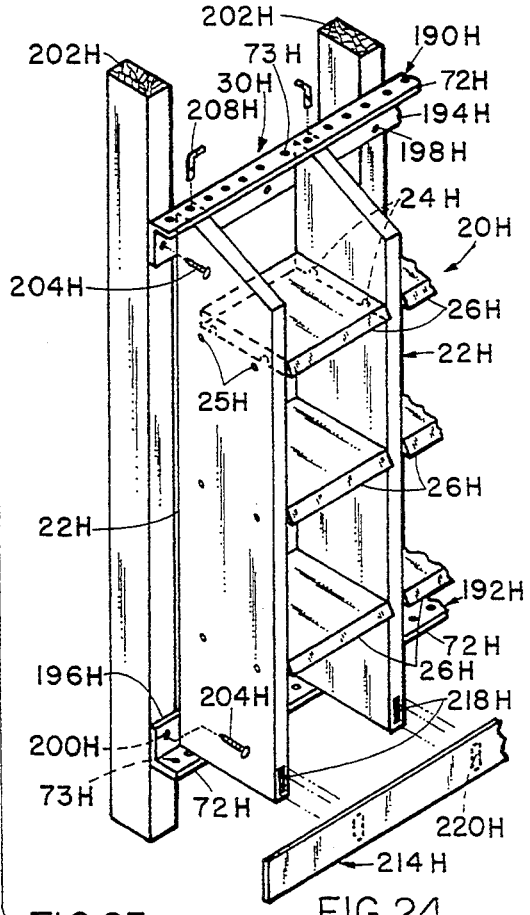
FIG. 24 is a perspective view of another modified display system embodying the present invention, the display system being shown as installed on a conventional building wall including 2×4 wooden studs.
Figure 26:
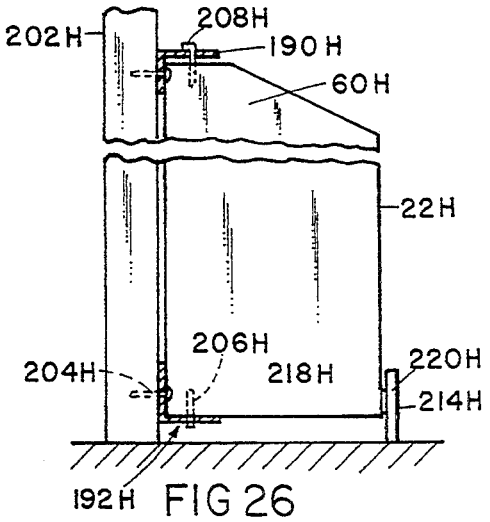
FIG. 26 is a fragmentary side view of the display system illustrated in FIG. 24.

Another modification of the display system embodying the present invention is contemplated which allows the display system to be installed on any wall or similar structure. Display system 20It (FIGS. 24 and 25) includes a pair of identical L-shaped brackets 190H and 192H. Brackets 190H and 192H include a first vertically oriented leg 194H and 196H, respectively, with holes 198H and 200H therein, respectively. Holes 198H and 200H are optimally spaced about 16" apart so that they can be aligned with 2×4 wooden studs 202H in a conventionally studded wall of a building. Brackets 190H and 192H can thus be secured by fasteners 204H to studs 202H. Brackets 190H and 192H further include a second laterally extending leg 72H with anchoring holes 73H located along their lengths.

Figure 25:
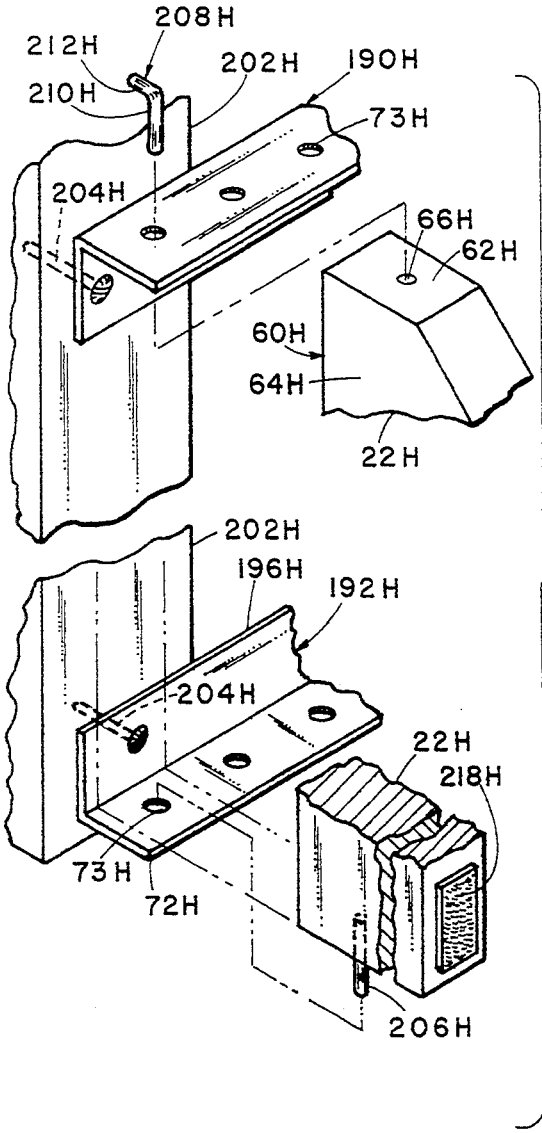
FIG. 25 is an exploded fragmentary perspective view of the display system illustrated in FIG. 24.

The lower rear corner of dividers 22H (and 23H) are modified to include a downwardly extending protruding pin 206H (FIG. 25). Pin 206H is shaped to securely engage a selected hole 73H in bottom bracket 192H. The upper rear corner of 60H of divider 22H includes a hole 66H. An L-shaped pin 208H includes a first section 210H adapted to extend through a selected hole 73H in top bracket 190H, and further includes a second section 212H that acts as a handle to facilitate inserting or removing pin 208H.

Shelves 26H are installable onto and between dividers 22H as previously described in reference to display system 20.

One or more elongated stabilizing panels or cross pieces 214H (FIGS. 24 and 25) are secured to dividers 22H. Cross piece 214H, for example, can be used as a kick panel to improve aesthetics as well as to perform the function of stabilizing display system 20H. In tile embodiment disclosed, cross piece 214H is releasably secured to the front edge of dividers 22H by mating patches 218H and 220H of hook-and-loop material, such as Velcro ®. It is contemplated that the hook-and-loop material can be extended the full length of cross piece 214H thus facilitating positioning dividers 22H in any spaced apart condition desired.

Figure 27:
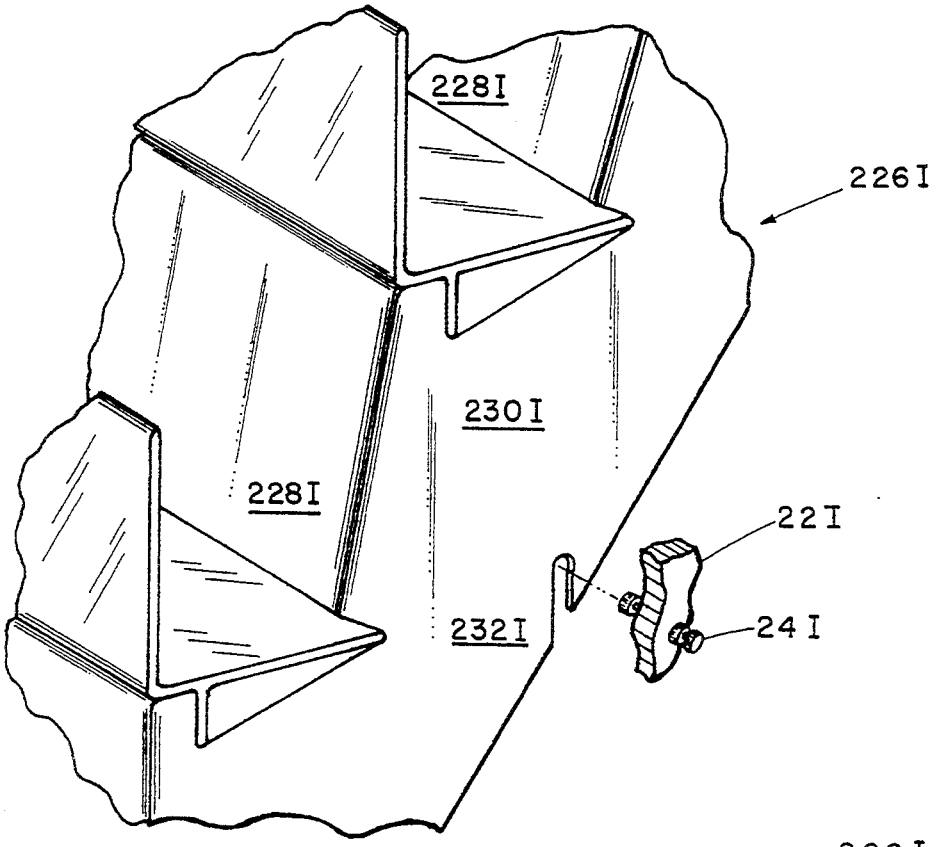
FIG. 27 is a fragmentary exploded perspective modified display system embodying the present invention, the display system including a vacuum-formed shelf.
Figure 28:
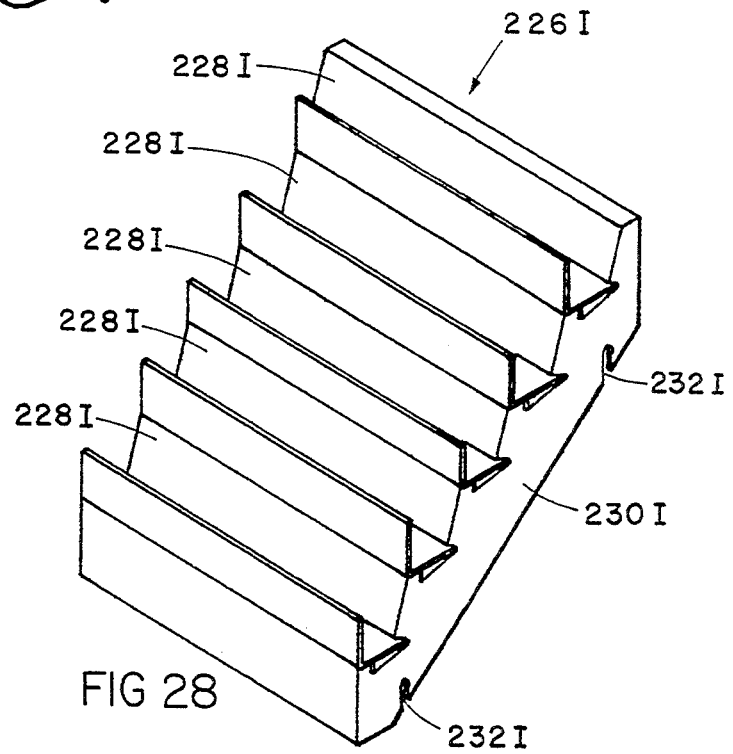
FIG. 28 is a perspective view of the vacuum-formed shelf illustrated in FIG. 27.

It is contemplated that a number of different shelves can be attached to dividers 22–22H. In FIGS. 27 and 28, there is a shown a vacuum-formed shelf 226I having multiple cascadingly positioned pockets 228I such as for holding and displaying greeting cards. The sides 230I of shelf 226I are notched with notches 232I. Notches 232I are shaped to securely engage pins 24I (and 25I), which pins can be selectively located in holes (68) of dividers 22I (and 23I). It is contemplated that additional specialty shelves can be readily constructed for specialized needs, such as for incorporating spring assisted forward feeding mechanisms such as for cigarettes and similar small packages.

Thus, the present invention provides display systems that include dividers interconnected by shelves and shelf-supporting pins. In one aspect, a display system is provided that is readily installable on conventional gondola shelving by a top bracket and bottom locators. In another aspect, the display system can be attached to a support such as to 2×4 wooden studs of a building wall. The display system can be readily assembled without use of skilled labor or special tools, and yet is adaptable to many different uses and arrangements.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A display system adapted for installation on a conventional shelving support having a base and a back, comprising:

a plurality of elongated upright dividers having tops, bottoms and sides with aperture means located in said sides;

a plurality of locators anchoring the bottoms, said locators being adapted to engage the shelving support base and selectively space said plurality of dividers apart from each other;

a top bracket extending substantially the width of the shelving support and adapted to releasably engage the shelving support back;

means for anchoring the top of each said divider to said top bracket;

a plurality of shelf-supporting members selectively located in said aperture means of said upright dividers, each of said shelf-supporting members including at least one end protruding from one of said sides; and a plurality of shelves each including opposing sides having means for releasably frictionally engaging said protruding ends, whereby assembly of said plurality of shelves to said shelf-supporting members, with said shelf-supporting members located in said dividers and with said dividers located by said plurality of locators and by said top bracket, provides a rigid construction which can be assembled by unskilled labor in a variety of different arrangements.

2. A display system as defined in claim 1 wherein said locators include protrusions adapted to selectively engage apertures in the shelving support base.

3. A display system as defined in claim 2 wherein said top bracket includes teeth adapted to selectively engage slots in the shelving support back.

4. A display system as defined in claim 3 wherein said plurality of shelf-supporting members includes a first type pin having a head and a single protruding end, said first type pin being useful on said dividers which are located at an end of the display system, and including a second type pin that has opposing protruding ends, said second type pin being useful on said upright dividers which are located in an intermediate position on the display system and which have a pair of said shelves located at an equal height on either side of the particular upright divider in which said second type pin is located.

5. A display system as defined in claim 4 wherein said plurality of upright dividers includes a first type upright divider which is useful in intermediate positions on the display system, and further includes a second type upright divider which is useful at the ends of the display system, said second type upright divider having a thickness half that of said first type upright divider so that the second type upright divider can be abutted against another of said second type upright dividers with said abutted upright dividers having a combined thickness equal to the thickness of said first type upright divider, whereby the outer dimension defined by the display system from end-to-end is maintained at a desired specific dimension, thus facilitating use of the display system on the conventional shelving.

6. A display system as defined in claim 5 wherein said means for engaging said top of said upright divider includes a protruding member extending downwardly from said top bracket into secure engagement with the top of said upright divider.

7. A display system as defined in claim 1 wherein said top bracket includes teeth adapted to selectively engage slots in the shelving support back.

8. A display system as defined in claim 1 wherein said shelf opposing sides include recesses, and wherein said plurality of shelving-support members includes a first type pin having a head and a single protruding end engageable by one of said shelf recesses, said first type pin being useful on said dividers which are located at an end of the display system, and including a second type pin having opposing protruding ends both of which are engageable by said shelf recesses, said second type pin being useful on said upright dividers which are located in an intermediate position on the display system and which have a pair of said shelves located at an equal height on either side of the particular upright divider in which said second type pin is located.

9. A display system as defined in claim 1 wherein said plurality of upright dividers includes a first type upright divider which is useful in intermediate positions on the display system, and further includes a second type upright divider which is useful at the ends of the display system, said second type upright divider having a thickness half that of said first type upright divider so that said second type upright divider can be abutted against another of said second type upright dividers with said abutted upright dividers having a combined thickness equal to the thickness of said first type upright divider, whereby the outer dimension defined by the display system from end-to-end is maintained at a desired specific dimension, thus facilitating use of the display system on the conventional shelving.

10. A display system as defined in claim 9 wherein said shelf opposing sides include recesses, and wherein said plurality of shelving-support members includes a first type pin having a head and a protruding end engageable by one of said shelf recesses, said first type pin including a first depression adapting said first type pin for use on said first type dividers and including a second depression adapting said first type pin for use on said second type half-thickness dividers, said recesses in said opposing sides of said plurality of shelves being adapted to engage one of said first and second depressions.

11. A display system as defined in claim 1 wherein said means for engaging said top of said upright divider includes a protruding member extending downwardly from said top bracket into secure engagement with the top of said upright divider.

12. A display system as defined in claim 1 wherein said top bracket includes an L-shaped center portion extending the width of said display system having a first leg and a second leg that stabilizes the first leg, and further includes opposing ends having teeth thereon for engaging slots in the conventional shelving support back.

13. A display system as defined in claim 12 wherein said means for engaging said divider tops includes a plurality of holes in said first leg and a plurality of fasteners selectively positioned in said holes.

14. A display system as defined in claim 1 wherein said opposing sides of said plurality of shelves each include vertically extending flanges with recesses being formed in said flanges.

15. A display system as defined in claim 14 wherein said recesses include notches adapted to engage said protruding ends of said shelf-supporting members from a direction parallel to said opposing sides.

16. A display system as defined in claim 15 wherein said shelf-supporting members include elongated pins with ring-shaped depressions formed on the protruding ends, the ring-shaped depressions being engageable by said notches in said shelves.

17. A display system as defined in claim 1 including an auxiliary shelving support base, said auxiliary shelving support base having a horizontal surface and further including teeth located at the rear outer corners thereof for engaging slots in the conventional shelving support back.

18. A display system as defined in claim 1 wherein said top bracket includes a laterally extending flange, and said means for anchoring includes a plurality of anchoring brackets, each said anchoring bracket including a first section constructed to releasably engage said flange and a second section constructed to releasably engage the top of said dividers.

19. A display system as defined in claim 18 wherein said top bracket and said anchoring bracket are interconnected by a depression and a protrusion, said top bracket flange including one of said depression and protrusion, and said first section of said anchoring bracket including the other of said depression and protrusion, said protrusion being adapted to releasably engage said depression.

20. A display system as defined in claim 19 wherein said anchoring bracket includes opposing sidewalls for engaging said sides of said dividers to stabilize said dividers.

21. A display system as defined in claim 1 wherein said dividers each include a front and a rear, said aperture means in said dividers including a first hole proximate one of said front and rear of said divider and further including a series of second holes proximate the other of said front and rear of said divider, said second holes being spaced from said first holes and spaced vertically from each other, whereby said shelf-supporting members can be selectively positioned in said first and second holes so that when said shelves are engaged with said shelf-supporting members, said shelves have a desired angularity with respect to horizontal for optimal customer viewing of merchandise being displayed on the shelves.

22. A display system comprising:

a plurality of spaced dividers having sides and material forming a plurality of vertically spaced holes extending through the dividers between the sides;

shelf-supporting fasteners each having a shaft and ends, the fasteners being positioned in selected ones of the holes in said dividers with the fastener shaft being located in the selected holes and with the ends protruding from the sides of each said divider, the ends of each fastener being constructed so that the fastener ends are securely engageable from a direction parallel said divider sides; and a plurality of shelves each including a midsection and opposing sides, said opposing sides each including notches frictionally engageable with the fastener ends in the direction parallel the divider sides so that a particular shelf can be positioned between the sides of a pair of dividers and press-fittingly forced onto the fastener ends from the direction parallel the divider sides, whereby an alternating arrangement of shelves and dividers can be made with the shelves being interconnected by fasteners extended through the dividers to create a secure and stable display system.

23. A display system comprising:

a plurality of spaced dividers having sides and material forming a plurality of vertically spaced holes extending through the dividers between the sides;

shelf-supporting fasteners each having a shaft and ends, the fasteners being positioned in selected ones of the holes in said dividers with the fastener shaft being located in the selected holes and with the ends protruding from the sides of each said divider, the ends of each fastener being constructed so that the fastener ends are securely engageable from a direction parallel said divider sides;

a plurality of of shelves each including a midsection and opposing sides, said opposing sides each including notches frictionally engageable with the fastener ends in the direction parallel the divider sides so that a particular shelf can be positioned between the sides of a pair of dividers and press-fittingly forced onto the fastener ends from the direction parallel the divider sides, whereby an alternating arrangement of shelves and dividers can be made with the shelves being interconnected by fasteners extended through the dividers to create a secure and stable display system;

a shelving support base with holes therein; and locators with a body engaging the upright divider and protrusions engaging selected of the holes in said shelving support base, said locators thus locating the dividers in a spaced arrangement that facilitates installation and also that stabilizes the display system upon assembly.

24. A display system as defined in claim 23 including a shelving support back with slots therein, said top bracket including teeth engaging selected of the slots in said shelving support back and means for engaging the dividers, the top bracket thus locating the dividers in a spaced arrangement that facilitates installation and also that stabilizes the display system upon assembly.

25. A display system as defined in claim 22 wherein said fasteners includes a first type fastener that includes a head and a single protruding end, said first type fastener being useful on said dividers which are located at an end of the display system, and including a second type fastener that has opposing protruding ends, said second type fastener being useful on said upright dividers which are located in an intermediate position on the display system and which have shelves located at an equal height on either side of the particular upright divider in which said second type fastener is located.

26. A display system as defined in claim 25 wherein said plurality of upright dividers includes a first type upright divider which is useful in intermediate positions on the display system, and further includes a second type upright divider which is useful at the ends of the display system, said second type upright divider having a thickness half that of said first type upright divider so that said second type upright divider can be abutted against another of said second type upright dividers with said abutted upright dividers having a combined thickness equal to the thickness of said first type upright divider, whereby the outer dimension defined by said display system from end-to-end is maintained at a desired specific dimension relative to the conventional shelving.

27. A display system as defined in claim 22 wherein said plurality of shelves includes a first type shelf having a midsection positioned in a horizontal position when installed, and a second type shelf positioned at an angle with respect to horizontal when installed, whereby the display system includes horizontally positioned shelves and angled shelves as desired.

28. A display system comprising:

a plurality of spaced dividers having sides and material forming a plurality of vertically spaced holes extending through the dividers between the sides;

shelf-supporting fasteners each having a shaft and ends, the fasteners being positioned in selected ones of the holes in said dividers with the fastener shaft being located in the selected holes and with the ends protruding from the sides of each said divider, the ends of each fastener being constructed so that the fastener ends are securely engageable from a direction parallel said divider sides;

a plurality of shelves each including a midsection and opposing sides, said opposing sides each including notches frictionally engageable with the fastener ends in the direction parallel the divider sides so that a particular shelf can be positioned between the sides of a pair of dividers and press-fittingly forced onto the fastener ends from the direction parallel the divider sides, whereby an alternating arrangement of shelves and dividers can be made with the shelves being interconnected by fasteners extended through the dividers to create a secure and stable display system; and an auxiliary shelving support base, said auxiliary shelving support base having a horizontal surface and further including teeth located at the rear outer corners thereof for engaging slots in the conventional shelving support back.

29. A display system as defined in claim 22 wherein said fastener ends include a depression that is constructed for secure frictional engagement by said shelf notches.

30. A display system, comprising:

a shelving support including a base with holes therein and a back with slots therein;

a plurality of elongated dividers having tops, bottoms and sides;

a plurality of locators engaging the bottoms, said locators including protrusions releasably engaging the holes in the shelving support base;

a top bracket including means for engaging the tops, said top bracket including teeth releasably engaging the slots in the shelving support back, said plurality of dividers being spaced apart by said plurality of locators and said top bracket;

a plurality of shelves; and shelf-supporting means for supporting and interconnecting said shelves to each other and to said dividers, said plurality of shelves each including opposing side edges with engaging means therein adapted to releasably frictionally engage particular of said shelf-supporting means from a direction parallel to said sides, whereby interconnection of said plurality of shelves to said shelf-supporting means with said dividers being located by said plurality of locators and by said top bracket permits quick assembly of the display system by unskilled labor and results in a display system which is structurally sound, aesthetically pleasing, and yet rearrangeable to satisfy different needs.

31. A display system as defined in claim 30 wherein said dividers include pin-receiving holes extending between said sides, and said shelf-supporting means includes a plurality of shelf-supporting pins selectively located in said holes of said upright dividers, each of said pins including at least one end protruding from one of said sides which is frictionally engageable by said shelf side edges.

32. A display system as defined in claim 31 wherein said engaging means on said shelf side edges includes notches.

33. A display system as defined in claim 30 wherein said shelves include flanges forming said side edges.

34. A flexible display system adapted for removable attachment to a conventional gondola shelf support structure having one or more back panels affixed to upstanding anchor rails, said rails having vertically spaced openings to receive shelf and divider supporting indicia and one or more bottom panels extending laterally forward from said back panels and including laterally spaced openings to receive additional shelf or divider supporting indicia, the display system comprising, in combination:

an inverted L-shaped top bracket with anchor means protruding outwardly from the vertical leg thereof for engagement with said rails through said rail openings to removably secure said bracket to the top of said back panels along the width of said support structure, the horizontal leg protruding outwardly and substantially parallel to said bottom panels, said horizontal leg including a plurality of laterally spaced anchor means;

a plurality of locator brackets having a U-shaped cross section including a web portion with one or more protrusions extending downwardly from the web portion of each locator and configured to fit into said bottom panel openings to removably anchor said locators onto the bottom panel extending outward from said back panels so that said U-shaped locators open upwardly;

divider panels extending generally the height of said support system and configured to fit snugly in said locator and having a height to fit snugly up to and beneath the horizontal leg of said top bracket, the top edge of each divider having means for engaging said anchor means; and a plurality of shelves secured to and between said dividers to form said display system.

35. A display system as defined in claim 34 wherein said anchor means includes a protruding member extending downwardly from said top bracket.

36. A display system as defined in claim 34 wherein said means for engaging said anchor means includes at least one recessed opening extending vertically, and said anchor means includes laterally spaced openings and fasteners extending through said laterally spaced openings into said at least one recessed opening.

37. A display system as defined in claim 34 wherein said dividers include second vertically spaced openings and said shelves include notches, and including shelf-supporting pins extending through selected of said second vertically spaced openings, said shelf-supporting pins including protruding ends frictionally engageable by said shelf notches from a direction parallel said shelf sides.

38. A display system for attachment to a wall, comprising:

an elongated top bracket and an elongated bottom bracket adapted for attachment to the wall in a predetermined spaced apart condition, said top bracket and said bottom bracket each extending the width of said display system and including a plurality of longitudinally spaced anchor means along their length;

divider panels having a top and a bottom defining a height sufficient to engage said top bracket and said bottom bracket when the brackets are secured in the predetermined spaced apart condition, the top and the bottom of each divider having means for releasably engaging selected of said anchor means, said brackets being constructed to support the weight of said divider panels when said divider panels are engaged therewith;

a plurality of shelves adapted to be secured between said dividers to form said display system; and shelf-supporting means on said divider panels for securely releasably engaging and supporting said shelves so that said display system becomes rigid upon installation of said shelves between said dividers.

39. A display system as defined in claim 38 wherein said divider panels include a front edge and a rear edge, and said means for engaging said anchor means of said bottom bracket are located proximate said rear edge and on the top and the bottom of said divider panels.

40. A display system as defined in claim 38 wherein said divider panels include a front edge, and including an elongated cross piece releasably attachable to each of said front edges to stabilize said divider panels.

41. A display system as defined in claim 40 wherein said front edges and said cross piece include mating patches of hook-and-loop material.

42. A display system as defined in claim 41 wherein said elongated cross piece forms a kick panel for said display system.

43. A display system as defined in claim 38 wherein said anchor means of said bottom bracket includes holes, and said divider panels include a rear edge and a fastener located proximate said rear edge, said fastener being adapted to engage selected of said holes in said bottom bracket to thus anchor said divider panels in a selected spaced apart condition.

44. A display system as defined in claim 43 wherein said anchor means of said top bracket includes holes, and including fasteners selectively extended through said holes into engagement with said divider panels to thus anchor said divider panels in a selected spaced apart condition.

45. A display system as defined in claim 38 wherein said anchor means of said top bracket includes holes, and including fasteners selectively extended through said holes into engagement with said divider panels to thus anchor said divider panels in a selected spaced apart condition.

46. A display system as defined in claim 38 wherein said top bracket and said bottom bracket have an identical shape.

47. A display system as defined in claim 38 wherein said top bracket and said bottom bracket both have an L-shaped profile.

48. A display system as defined in claim 38 including a plurality of shelves having different widths that can be selectively positioned between said divider panels.

49. A display system as defined in claim 38 wherein said divider panels each include a front and a rear, and wherein said shelf-supporting means in said divider panels include a first hole proximate one of said front and said rear of said divider, and further includes a series of second holes proximate the other of said front and said rear, said second holes being spaced an equal distance from said front holes in a predetermined pattern, and still further includes shelf-supporting members selectively positionable in said first and second holes, whereby said shelf-supporting members can be selectively positioned in said first and second holes so that, when said shelves are engaged with said shelf-supporting members, said shelves have a desired angularity with respect to horizontal for optimal consumer viewing of merchandise being displayed on the shelves.

50. A display system as defined in claim 38 wherein said divider panels include sides and apertures extending through said divider panels between the sides, wherein said means on said divider panels for securely engaging said shelves includes a plurality of shelf-supporting members selectively located in said apertures on said divider panels, said shelf-supporting members including at least one end protruding from the sides of said dividers, and wherein said plurality of shelves each include opposing sides having means for releasably frictionally engaging said protruding ends from a direction parallel the divider panel sides so that assembly of said plurality of shelves to said shelf-supporting members provides a rigid construction and interconnected arrangement.

* * * * *